US009669628B2

(12) United States Patent
Kishimoto et al.

(10) Patent No.: US 9,669,628 B2
(45) Date of Patent: Jun. 6, 2017

(54) LIQUID EJECTION HEAD SUBSTRATE, METHOD OF MANUFACTURING THE SAME, AND METHOD OF PROCESSING SILICON SUBSTRATE

(71) Applicant: CANON KABUSHIKI KAISHA, Tokyo (JP)

(72) Inventors: Keisuke Kishimoto, Yokohama (JP); Taichi Yonemoto, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/860,536

(22) Filed: Sep. 21, 2015

(65) Prior Publication Data

US 2016/0082731 A1 Mar. 24, 2016

(30) Foreign Application Priority Data

Sep. 24, 2014 (JP) ..... 2014-193672

(51) Int. Cl.
*B41J 2/14* (2006.01)
*B41J 2/16* (2006.01)

(52) U.S. Cl.
CPC ..... *B41J 2/14145* (2013.01); *B41J 2/1603* (2013.01); *B41J 2/1629* (2013.01); *B41J 2/1631* (2013.01); *B41J 2/1634* (2013.01)

(58) Field of Classification Search
None
See application file for complete search history.

(56) References Cited

U.S. PATENT DOCUMENTS 6,805,432 B1 10/2004 Milligan
7,727,411 B2 * 6/2010 Yamamuro ..... B41J 2/14145 216/17
2011/0194995 A1 * 8/2011 Rigler ..... B01F 5/0471 422/504
2014/0307029 A1 * 10/2014 Xie ..... B41J 2/03 347/47

FOREIGN PATENT DOCUMENTS

JP 10-181032 A 7/1998
JP 11-348282 A 12/1999
JP 2001-162802 A 6/2001
JP 2004-148824 A 5/2004
JP 2007-237515 A 9/2007

* cited by examiner

*Primary Examiner* — Lisa M Solomon
(74) *Attorney, Agent, or Firm* — Canon U.S.A. Inc., IP Division

(57) ABSTRACT

The wall of each supply path formed in a silicon substrate has such a shape that a plurality of regions distinguished from each other due to different inclinations to a first surface of the silicon substrate are connected to each other between the first surface and a second surface of the silicon substrate and the width of the supply path is maintained or expands from the first surface to second surface of the silicon substrate. An internal opening is formed by one of the regions that is most steeply inclined to the first surface of the silicon substrate. A region reducing the squeezing of an adhesive into the internal opening is placed between the internal opening and the second surface of the silicon substrate.

2 Claims, 4 Drawing Sheets

LIQUID EJECTION HEAD SUBSTRATE, METHOD OF MANUFACTURING THE SAME, AND METHOD OF PROCESSING SILICON SUBSTRATE

BACKGROUND OF THE INVENTION

Field of the Invention

The present invention relates to a liquid ejection head substrate, a method of manufacturing the same, and a method of processing a silicon substrate to form a through-hole in the silicon substrate.

Description of the Related Art

One of liquid ejection heads ejecting liquids is a type of liquid ejection head which includes an ejection energy-generating element placed on a surface of a substrate and which ejects liquid in a normal direction of the substrate surface. This type of liquid ejection head is referred to as a side shooter-type head. A substrate having an ejection energy-generating element placed on a surface thereof is referred to as a liquid ejection head substrate. A side shooter-type head is used as, for example, an inkjet printhead that ejects ink, which is liquid, to make a record on a recording medium such as a recording sheet. In the side shooter-type head, a silicon substrate made of single-crystalline silicon is usually used as a liquid ejection head substrate. In descriptions below, a surface of a liquid ejection head substrate that has an ejection energy-generating element placed thereon is referred to as a first surface and a surface of the liquid ejection head substrate that is on the back side of the first surface is referred to as a second surface. In the side shooter-type head, a through-hole is formed in the silicon substrate, which is a liquid ejection head substrate, and is used as a supply path and liquid is supplied to the position of an ejection energy-generating element placed on a first surface of the silicon substrate from the second surface side of the silicon substrate through the supply path. The supply path is formed in such a manner that, for example, a second surface of the silicon substrate is etched.

Japanese Patent Laid-Open No. 10-181032 discloses an example of a method of manufacturing a side shooter-type head configured as an inkjet printhead. In the method, in order to suppress the variation in opening diameter of supply paths in a first surface of a silicon substrate which is a liquid ejection head substrate, sacrificial layers are placed on the first surface such that a substrate material can be selectively etched depending on the positions of through-holes for forming supply paths. Therefore, the supply paths are formed so as to have a predetermined opening diameter depending on the size of each sacrificial layer.

U.S. Pat. No. 6,805,432 discloses a method of manufacturing an inkjet printhead using a silicon substrate having a surface of which the plane indices are (100) as a liquid ejection head substrate. In the method disclosed in U.S. Pat. No. 6,805,432, after the silicon substrate is dry-etched using an etching mask layer placed on a second surface of the silicon substrate, the silicon substrate is further anisotropically etched using the same etching mask layer. During dry etching, holes are formed by etching so as not extend through the silicon substrate. The holes are then processed into through-holes by anisotropic etching. This allows a liquid ejection head substrate having supply paths formed from the through-holes to be obtained. The supply paths have such a cross-sectional shape that an intermediate portion laterally expands.

In the method disclosed in U.S. Pat. No. 6,805,432, dry etching and anisotropic etching, that is, wet etching both use the same etching mask layer. Therefore, the opening width of the supply paths in the second surface is determined depending on the opening width of the etching mask layer placed on the second surface of the silicon substrate and the amount of engraving by dry etching. Incidentally, in a configuration in which supply paths having slit-shaped openings extending in one direction are arranged in an elongated substrate and a plurality of ejection energy-generating elements are arranged along the openings, the term "opening width" as used herein refers to the lateral opening width of the openings of the supply paths that extend in one direction. A lateral direction of the openings of the supply paths that extend in one direction is defined as a width direction of a liquid ejection head. In the case of using the liquid ejection head as an inkjet printhead, a plurality of ejection energy-generating elements are usually arranged along openings of supply paths that extend in one direction. In the method disclosed in U.S. Pat. No. 6,805,432, a silicon (111) plane which has a relatively low etching rate and which is inclined at 54.7° to a (100) plane is formed using the anisotropic etching of silicon and supply paths are open to a first surface. Therefore, in order to increase the opening width of the supply paths in the first surface to a certain extent, the amount of engraving by dry etching needs to be increased. However, as the amount of engraving is increased, the time taken for dry etching is increased. Hence, production efficiency may possibly be reduced.

Japanese Patent Laid-Open No. 2004-148824 discloses a method of manufacturing an inkjet printhead by forming supply paths in a silicon substrate. The supply paths are formed in such a manner that after the silicon substrate is laser-trenched, the silicon substrate is etched. In this method, the amount of engraving by laser processing needs to be increased so as to be substantially comparable to the thickness of the silicon substrate. However, as the amount of engraving by laser processing is increased, the time taken for laser processing is increased. Hence, production efficiency may possibly be reduced.

Japanese Patent Laid-Open No. 2007-237515 discloses a method of manufacturing a liquid ejection head substrate and describes that supply paths are formed in such a manner that non-through holes are formed in a silicon substrate using a laser beam and the silicon substrate is then anisotropically etched. In this method, the supply paths are formed so as to have such a cross-sectional shape that an intermediate portion is laterally wide and therefore there is a limitation in reducing the lateral size of a liquid ejection head.

In a step of assembling the liquid ejection head, the liquid ejection head substrate is mounted on a support member. The support member supports the liquid ejection head substrate and has a liquid channel for supplying liquid to the supply paths from a tank or the like. The liquid ejection head substrate is mounted on the support member in such a manner that, for example, an ultraviolet/heat-curable adhesive is transferred or applied to a surface of the support member and the liquid ejection head substrate is precisely aligned with the support member and is then pressed against the support member. In this operation, a second surface of the liquid ejection head substrate is brought into contact with the support member. For example, image processing or the like is used for precise alignment. An ultraviolet ray is applied to the adhesive that extends on a peripheral portion of the liquid ejection head substrate, which is pressed against the support member, whereby the liquid ejection head substrate is temporarily fixed to the support member. In this operation, a region interposed between the liquid ejection head substrate and the support member is hidden from the ultraviolet ray and therefore a portion of the adhesive that is present in the region interposed between the liquid ejection head substrate and the support member remains uncured. Thereafter, a heat-curing step is performed, whereby the adhesive including the portion present in the region interposed between the liquid ejection head substrate and the support member is cured.

In the above assembling step, when the liquid ejection head substrate is pressed against the support member having the adhesive transferred or applied thereto, the uncured adhesive is squeezed into the supply paths because the supply paths are open to the second surface of the liquid ejection head substrate in this point of time. The adhesive squeezed into the supply paths is thereafter cured in the heat-curing step. When the cured adhesive squeezed into the supply paths is present in narrow portions of the supply paths, the flow of liquid in the supply paths is interrupted. In particular, when liquid flowing in the supply path contains bubbles, the bubbles are blocked in the narrow portions of the supply paths by the cured adhesive and grow to significantly interrupt the flow of the liquid. When liquid contains bubbles, the ease of discharging the bubbles from supply paths together with the liquid is referred to as bubble releasability. In liquid ejection head substrates, supply paths with good bubble releasability need to be arranged. Japanese Patent Laid-Open Nos. 11-348282 and 2001-162802 disclose an inkjet printhead manufactured by bonding a plurality of substrates with an adhesive. In the inkjet printhead, in order to prevent the adhesive from flowing into an ink channel, an excess of the adhesive is stored in an adhesive storage region formed in a surface of each substrate. However, even if an adhesive storage region such as a recessed portion or a groove is formed in a surface of a substrate, an adhesive cannot be sufficiently prevented from being squeezed into a supply path. In a liquid ejection head, a surface of a liquid ejection head substrate is required to be not inclined to a surface of a support member and therefore the liquid ejection head substrate needs to be pressed against the support member. An adhesive is necessarily squeezed into a supply path by pressing the liquid ejection head against the support member. The amount of the squeezed adhesive is reduced in such a manner that the amount or state of the adhesive is regulated when the adhesive is transferred or applied. However, the standard width of a region to which the adhesive is transferred or applied is very small in terms of manufacture and therefore very difficult control is required during manufacture.

SUMMARY OF THE INVENTION

A liquid ejection head substrate according to an aspect of the present invention has a first surface and a second surface opposite to the first surface and includes a plurality of ejection energy-generating elements placed on the first surface.

The liquid ejection head substrate has a plurality of supply paths, extending between the first and second surfaces, for supplying liquid to the ejection energy-generating elements.

The distance between the centers of the neighboring supply paths in the first surface is 1 mm or less.

The wall of each supply path has a cross-sectional shape which is perpendicular to the first surface, in which a plurality of regions distinguished from each other due to different inclinations to the first surface are connected to each other between the first and second surfaces, and in which the width of the supply path is maintained or expands from the first surface toward the second surface.

The supply path has an internal opening formed by one of the regions that is most steeply inclined to the first surface and a mechanism, located between the second surface and one of the regions that is most steeply inclined, reducing the squeezing of an adhesive into the internal opening.

Further features of the present invention will become apparent from the following description of exemplary embodiments with reference to the attached drawings.

DESCRIPTION OF THE EMBODIMENTS

In a liquid ejection head substrate, the opening width of supply paths needs to be small in order to reduce the lateral size of a liquid ejection head. Furthermore, the squeezing of an adhesive into the supply paths is required to be reduced when the liquid ejection head substrate is mounted on a support member. In general, supply paths are formed in the liquid ejection head substrate in such a manner that a mask is formed on a second surface of the liquid ejection head substrate and the second surface thereof is anisotropically etched. However, in the case of using such a step, the etching time for the formation of the supply paths is long and the opening width of the supply paths in the second surface is large. Therefore, the downsizing of the liquid ejection head is difficult. The following method is effective in reducing the etching time: a method in which a silicon substrate is partly removed and is then anisotropically etched as described in Japanese Patent Laid-Open No. 2007-237515. If the etching rate of each plane orientation during anisotropic etching, then the lateral size of the supply paths tends to be increased depending on the etching time. Therefore, in order to prevent the lateral expansion of the supply paths, the amount of silicon removed before anisotropic etching needs to be increased. Increasing the amount of silicon removed before anisotropic etching causes a reduction in production efficiency.

Investigations on reducing the squeezing of the adhesive into the supply paths show that in order to allow the liquid ejection head to function, the squeezing of the adhesive need not necessarily be reduced and it is only necessary to prevent the blocking of the supply paths due to the squeezing thereof and the reduction of bubble releasability.

An embodiment of the present invention provides a liquid ejection head substrate and a method of manufacturing the same. In the liquid ejection head, the blocking of supply paths or the reduction of bubble releasability does not occur when the liquid ejection head substrate is mounted on a support member using an adhesive and the opening width of the supply paths can be reduced.

Another embodiment of the present invention provides a method of processing a silicon substrate suitable for manufacturing a liquid ejection head in which the blocking of supply paths or the reduction of bubble releasability does not occur when the liquid ejection head substrate is mounted on a support member using an adhesive and in which the opening width of the supply paths can be reduced.

Figure 1:
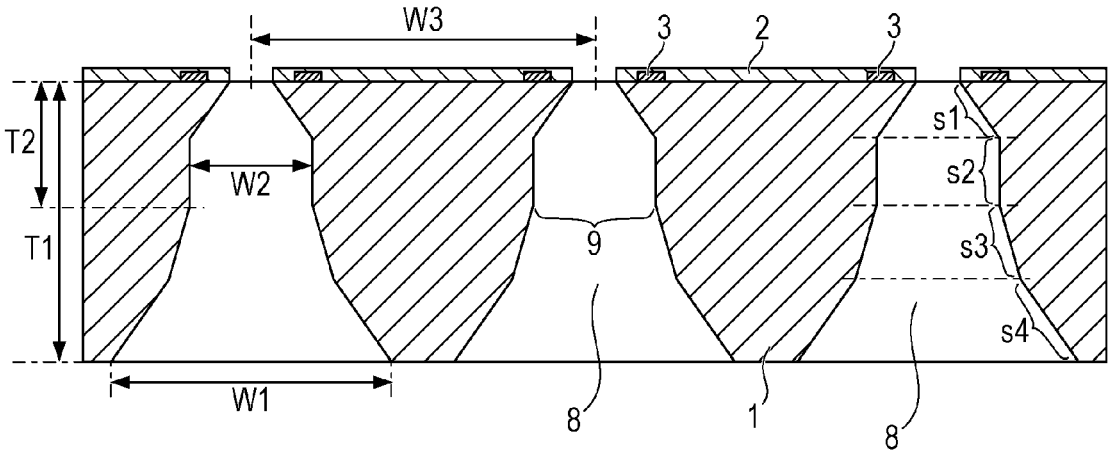
FIG. 1 is a sectional view of a liquid ejection head substrate according to an embodiment of the present invention.

Preferred embodiments of the present invention will now be described with reference to the attached drawings. FIG. 1 shows the cross-sectional configuration of a liquid ejection head substrate according to an embodiment of the present invention. The liquid ejection head substrate is one formed using a silicon substrate 1 having a surface of which the plane indices are (100). The front surface and back surface of the silicon substrate 1 are hereinafter referred to as a first surface and a second surface, respectively. Supply paths 8 which are through-holes extend from the second surface to the first surface. In the silicon substrate 1, the second surface is opposite to the first surface. In the first surface, ejection energy-generating elements 3 are placed near openings of the supply paths 8. An etching stop layer 2 is placed over the first surface including the ejection energy-generating elements 3. The etching stop layer 2 is one that stops the progress of etching when the supply paths 8 are formed by etching as described below. The etching stop layer 2 functions as a passivation layer for the ejection energy-generating elements 3, which are placed on the first surface. Though FIG. 1 shows the cross-sectional shape of the liquid ejection head substrate, the supply paths 8 may be formed so as to have slit-shaped openings extending away from the plane of FIG. 1. In this case, FIG. 1 shows a lateral cross section of each supply path 8, which is slot-shaped.

In this embodiment, the liquid ejection head substrate is characterized by the cross-sectional shape of the supply paths 8. The supply paths 8 are formed by etching the second surface and therefore have a shape tapering from the second surface toward the first surface as a whole. An internal opening 9 is present in each supply path 8. Referring to FIG. 1, T2 is one-half or less of T1 and W2 is one-half or less of W1, where T1 is the thickness of the silicon substrate 1, T2 is the distance from the first surface to the internal opening 9, W1 is the opening width of the supply path 8 in the second surface, and W2 is the opening width of the internal opening 9. In other words, the internal opening 9 is located apart from the first surface at a distance corresponding to one-half or less of the thickness of the silicon substrate 1. The internal opening 9 is a portion serving as an entrance to a narrow portion of the supply path 8. In a distance range from the internal opening 9 toward the first surface, the wall of the supply path 8 is substantially perpendicular to the first surface. The wall of the supply path 8 tapers from the internal opening 9 toward an opening of the supply path 8 in the first surface. In the tapering region, the angle made by the wall of the supply path 8 with the first surface is substantially constant. Thus, the width of the opening of the supply path 8 in the first surface is less than W2. On the other hand, the wall of the supply path 8 has at least two regions which are arranged from the internal opening 9 to an opening of the supply path 8 in the second surface and which are distinguished from each other due to different inclinations to the first surface. The at least two regions are connected to each other such that the width of the supply path 8 expands toward the second surface. The at least two regions are located between the internal opening 9 and the second surface. One of the at least two regions that is close to the internal opening 9 is steeply inclined to the first surface and one of the at least two regions that is close to the second surface is gently inclined to the first surface.

In this embodiment, the wall of the supply path 8 is composed of four or more regions distinguished from each other due to different inclinations. In particular, as shown in FIG. 1, the wall of the supply path 8 is composed of four regions: a first region s1, a second region s2, a third region s3, and a fourth region s4. The region s2 is the second from the first surface, extends from the internal opening 9 toward the first surface, and has a wall substantially perpendicular to the first surface. The region s1 is located between the first surface and the region s2 and has a tapered cross section. The region s3 is located on the internal opening 9 side and the region s4 is located on the second surface side. The region s3 is more steeply inclined to the first surface as compared to the region s4. Since the supply path 8 has such a cross-sectional shape, the adhesive, which is squeezed when the liquid ejection head substrate is mounted on the support member using the adhesive, remains on the region s4, which is next to the second surface and is gently inclined, and does not reach the narrow portion of the supply path 8. Therefore, the liquid ejection head substrate can reduce the blocking of the supply path 8 and has good bubble releasability.

As shown in FIG. 1, in the liquid ejection head substrate, the regions s3 and s4 function as mechanisms reducing the squeezing of the adhesive into the internal opening 9. Thus, in the most basic configuration of the supply path 8, the number of regions which have a cross-sectional shape perpendicular to the first surface and which are distinguished from each other due to different inclinations to the first surface may be three or less. The supply path 8 has such a shape that the width thereof is maintained or expands from the first surface toward the second surface. The internal opening 9 is formed by one of the regions that is most steeply inclined to the first surface. The supply path 8 includes a mechanism, located between the second surface and one of the regions that is most steeply inclined, reducing the squeezing of the adhesive into the internal opening 9.

FIG. 1 illustrates three of the supply paths 8. This shows that the three supply paths 8 can be formed in the silicon substrate 1 together so as to have slit-shaped openings extending away from the plane of FIG. 1. A liquid ejection head substrate corresponding to a single liquid ejection head can be obtained by dividing the silicon substrate 1 having the supply paths 8 at intermediate positions between the neighboring supply paths 8. Alternatively, the silicon substrate 1 having the supply paths 8 may be directly used to configure a liquid ejection head capable of ejecting different types of liquids together without dividing the silicon substrate 1.

In the liquid ejection head substrate, the wall of the supply path 8 in the region s2 is perpendicular and therefore the opening width of the supply path 8 in the second surface can be made smaller as compared to conventional supply paths of the liquid ejection head substrate that are formed by anisotropic etching so as to have a tapered shape. Therefore, the interval W3 between the centerlines of the neighboring supply paths 8 in the undivided silicon substrate 1 can be made smaller than that of conventional supply paths. When the silicon substrate 1 is, for example, a common silicon wafer with a thickness T1 of 725 μm, the interval W3 between the centerlines of the neighboring supply paths 8 can be set to 1 mm or less.

A method of processing a silicon substrate according to an embodiment of the present invention is described below. The silicon substrate can be used to manufacture the liquid ejection head substrate. In the processing method, an etching mask layer having openings is formed on a second surface of the silicon substrate and a plurality of guide holes are formed in the silicon substrate through the openings so as to extend from the second surface. The guide holes can be formed in the silicon substrate in the form of non-through holes by, for example, laser thermal processing or laser ablation in such a manner that the silicon substrate is irradiated with a laser beam. The second surface of the silicon substrate is anisotropically etched. An etchant used may be a silicon anisotropic etchant such as potassium hydroxide or tetramethylammonium hydroxide (TMAH). In particular, the etchant preferably has a higher etching rate for the (100) plane than for the (110) plane of silicon. The etchant may be a liquid containing an additive. The etchant may contain, for example, an additive containing polyethylene glycol and a polyoxyethylene derivative. When being used for anisotropic etching, the etchant may be a solution containing 15% to 25% by mass of TMAH and 0.01% to 1% by mass of an additive. The additive may be, for example, one or more selected from the group consisting of polyethylene glycol, polyoxyalkylene alkyl ether, and octylphenoxy polyethoxyethanol. The additive may be polyethylene glycol (PEG) with a molecular weight of 100 to 1,000. Polyoxyalkylene alkyl ether may be, for example, polyoxyethylene alkyl ether. When the additive is polyethylene glycol, the concentration of the additive in the etchant is preferably 0.05% to 1% by mass. When the additive is polyoxyalkylene alkyl ether or octylphenoxy polyethoxyethanol, the concentration of the additive in the etchant is preferably 0.01% to 0.5% by mass.

The etchant enters the guide holes from the second surface side and therefore etching proceeds such that the guide holes are fattened, whereby some of the guide holes are combined into a single hole. After the guide holes are combined, etching proceeds from the ends of the combined guide holes toward the first surface and also proceeds in a width direction of the combined guide holes. In the second surface, etching proceeds in portions other than the guide holes. When portions from which silicon is removed by etching reach the first surface, etching is finished. In this embodiment, selecting the etchant, which is used for anisotropic etching, allows etching to proceed at a position closer to the first surface than an intermediate portion of each guide hole such that the guide hole is laterally expanded. This allows the wall of the supply path 8 in the region s2 to be perpendicular to the first surface as described above.

The method of processing the silicon substrate is suitable for forming through-holes such as liquid supply paths (for example, ink supply paths) in a process for manufacturing a structure including the silicon substrate, for example, a liquid ejection head such as an inkjet head. In descriptions below, the formation of an inkjet printhead substrate is used as an example of the present invention. The scope of the present invention is not limited to the formation of the inkjet printhead substrate. The processing method is applicable to the fabrication of a biochip, the manufacture of a liquid ejection head substrate for printing electronic circuits, and the like in addition to the formation of the inkjet printhead substrate. Examples of a liquid ejection head to which the processing method is applied include inkjet printheads and heads for manufacturing color filters.

Figure 2A:
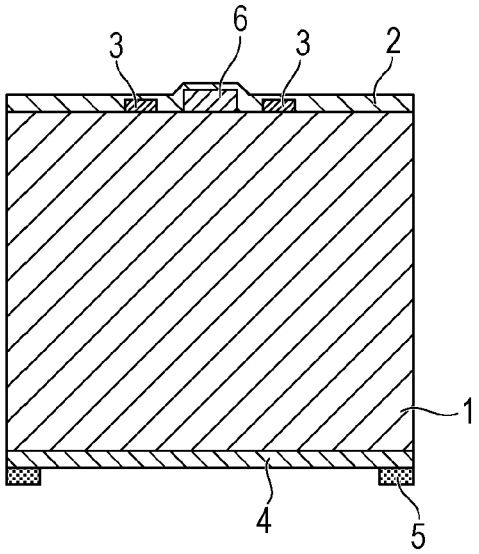
FIGS. 2A to 2D are schematic sectional views sequentially showing steps of forming the liquid ejection head substrate shown in FIG. 1.
Figure 2B:
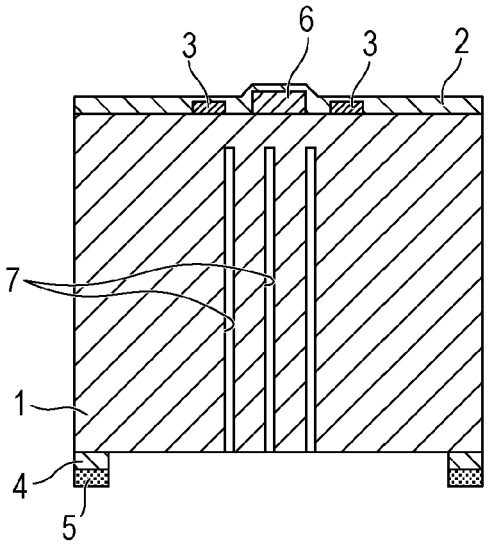
Figure 2C:
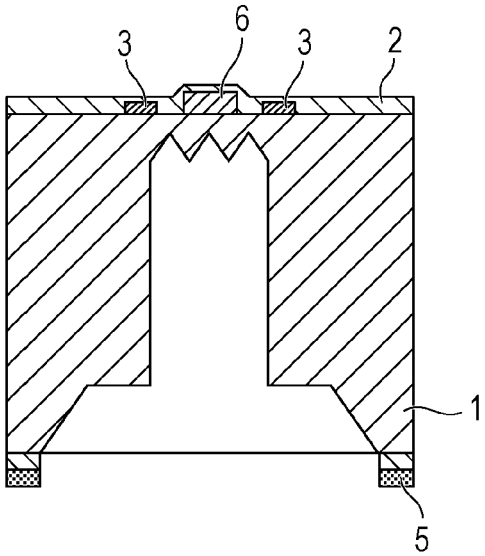
Figure 2D:
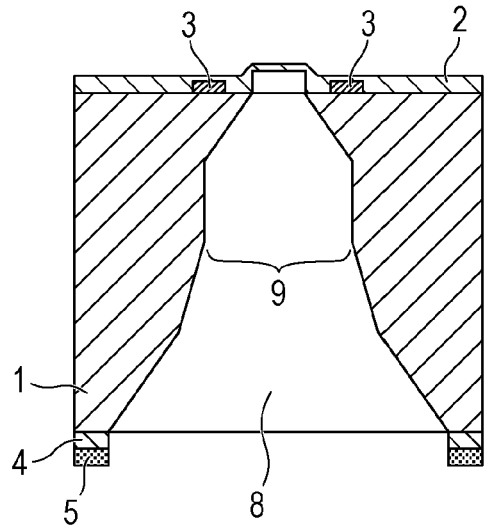

FIGS. 2A to 2D sequentially show examples of steps of forming the liquid ejection head substrate. Though FIG. 2D illustrates one of supply paths 8 formed in a silicon substrate 1, the supply paths 8 can be formed in the silicon substrate 1 together in one step, whereby the liquid ejection head substrate can be formed so as to have the supply paths 8. Referring to FIGS. 2A to 2D, ejection energy-generating elements 3, serving as electrothermal converting elements, generating energy for ejecting ink are placed on a first surface of the silicon substrate 1 that is a (100) crystal plane. The electrothermal converting elements can be formed using, for example, tantalum nitride (TaN). In the first surface, sacrificial layers 6 are placed at positions corresponding to openings of the supply paths 8. An etching stop layer 2 is placed over the first surface of the silicon substrate 1 and the sacrificial layers 6. The etching stop layer 2 serves as a protective layer for the ejection energy-generating elements 3 and has etching resistance.

The ejection energy-generating elements 3 are electrically connected to control signal input electrodes (not shown) for driving the ejection energy-generating elements 3. The silicon substrate 1 has a thickness of about 725 μm. In this embodiment, the silicon substrate 1 is a portion of the inkjet printhead substrate. Actually, a wafer is similarly processed and is then divided into pieces corresponding to individual inkjet printheads. The silicon substrate 1 may be overlaid with a resin coating layer for forming an ink channel or the like.

Though the sacrificial layers 6 are effective in precisely defining regions for forming the supply paths 8 for liquids such as ink, the sacrificial layers 6 are not essential for the present invention. The etching stop layer 2 is made of a material resistant to a material used for anisotropic etching. The etching stop layer 2 functions as a partition or the like when a structure (for example, a member for forming an ink channel or the like) is formed on the first surface of the silicon substrate 1. In the case of using the etching stop layer 2 and the sacrificial layers 6 alone or in combination, the etching stop layer 2 and the sacrificial layers 6 may be formed on the silicon substrate 1 in a stage prior to anisotropic etching. The timing and order of forming the etching stop layer 2 and the sacrificial layers 6 in a stage prior to anisotropic etching are arbitrary. The etching stop layer 2 and the sacrificial layers 6 can be formed by a known method.

As shown in FIG. 2A, a $SiO_2$ (silicon dioxide) layer 4 which is an oxide film is formed on a second surface of the silicon substrate 1. An etching mask layer 5 having openings is formed on the $SiO_2$ layer 4. The openings are regions where anisotropic etching is initiated. The etching mask layer 5 can be formed using, for example, a polyamide resin. The $SiO_2$ layer 4 may be partly removed before the formation of guide holes 7 or during an anisotropic etching step.

Next, the second surface of the silicon substrate 1 is irradiated with a laser beam, whereby the guide holes 7 are formed so as to extend from the second surface toward the first surface as shown in FIG. 2B. This step is referred to as a guide hole-forming step. The guide holes 7 do not reach the first surface and are non-through holes. For example, a laser beam of the fundamental wave (a wavelength of 1,064 nm), second harmonic (a wavelength of 532 nm), or third harmonic (a wavelength of 355 nm) of an yttrium-aluminium-garnet (YAG) laser can be used to form the guide holes 7. The power and frequency of the laser beam are each set to an adequate value.

The guide holes 7 preferably have a diameter of 5 μm to 100 μm. When the diameter of the guide holes 7 is 5 μm or more, an etchant is likely to enter the guide holes 7 during anisotropic etching in a subsequent step. When the diameter of the guide holes 7 is 100 μm or less, the guide holes 7 can be formed in a relatively short time.

The guide holes 7 are preferably formed by laser beam ablation such that the guide holes 7 are open to the second surface and the distance from the end of each guide hole 7 to the first surface is 10 μm to 125 μm. When the silicon substrate 1 has a thickness of, for example, 725 μm, the guide holes 7 preferably have a depth of 600 μm to 715 μm. When the thickness of the silicon substrate 1 is 725 μm and the depth of the guide holes 7 is 600 μm or more, the time taken for anisotropic etching can be shortened and the opening width of the supply paths 8 can be made small. When the depth of each guide hole 7 is 715 μm or less and the distance from the end of the guide hole 7 to the first surface is 10 μm or more, the heat of the laser beam or the like is unlikely to be transferred to, for example, a structure, such as a channel-forming member, formed on the first surface of the silicon substrate 1 and therefore a problem such as deformation can be suppressed.

The interval between the guide holes 7 (herein, the distance between the centers of the guide holes 7) depends on the diameter of the guide holes 7 and may be, for example, 60 μm in each of two directions perpendicular to a surface of the silicon substrate 1. In particular, in the case where the supply paths 8 are formed so as to have slit-shaped openings extending in one direction, the guide holes 7 are preferably formed such that the guide holes 7 make two or more rows and the interval between the guide holes 7 is 25 μm to 115 μm in a width direction. In the above case, the guide holes 7 are preferably formed such that the interval between the guide holes 7 is 25 μm to 115 μm in a longitudinal direction of the supply paths 8 and the guide holes 7 make a plurality of rows. When the interval between the guide holes 7 is within the above range, the supply paths 8 can be prevented from being connected to or each other during the formation of the supply paths 8 in the silicon substrate 1. Furthermore, the target processing depth of the guide holes 7 is likely to be adjusted to a desired depth and the supply paths 8 can be prevented from expanding.

In the case where the supply paths 8 are formed so as to have the slit-shaped openings extending in one direction, the guide holes 7 are preferably formed so as to make two or more rows symmetric about the longitudinal centerline of each supply path 8. When the number of rows of the guide holes 7 is odd, the guide holes 7 may be formed such that the center row is placed on the longitudinal centerline of the supply path 8.

The laser beam used to process the guide holes 7 is not particularly limited and may have a wavelength capable of drilling silicon. The fundamental wave (a wavelength of 1,064 nm) of the YAG laser is widely used to thermally process silicon and may be used to form the guide holes 7. Alternatively, the guide holes 7 may be formed by laser beam ablation, that is, a so-called laser ablation process. The guide holes 7 can be formed after the $SiO_2$ layer 4 is partly removed through the openings of the etching mask layer 5 formed on the second surface of the silicon substrate 1 such that silicon surfaces serving as surfaces where anisotropic etching is initiated are exposed.

Next, the second surface of the silicon substrate 1 is anisotropically etched using an etchant having a higher etching rate for a (100) plane than for a (110) plane. The etchant used may be, for example, a solution containing 22% by mass of TMAH and 0.01% to 1% of polyethylene glycol 600 (polyethylene glycol with a molecular weight of 600). When the concentration of polyethylene glycol 600 in the etchant is less than 0.01% by mass, the width of an internal opening 9 formed in each supply paths 8 is large. However, when the concentration thereof is more than 1% by mass, the amount of the discharged etchant is large. The concentration of polyethylene glycol 600 in the etchant is preferably 0.05% to 0.5% by mass. The concentration of TMAH in the etchant is preferably 15% to 22% by mass. The concentration of silicon in the etchant is controlled to 6% by mass or less. When the silicon concentration is more than 6% by mass, a change in etching rate is large and the time taken for etching is long.

As shown in FIG. 2C, etching is initiated from all the walls of the guide holes 7. In some places, etching proceeds such that a (111) plane of which the etching rate is low is formed. In other places, etching proceeds along a (100) plane and (110) plane of which the etching rate is high. Anisotropic etching is performed until the supply paths 8 are formed so as to extend to the first surface of the silicon substrate 1 as shown in FIG. 2D. In this operation, the sacrificial layers 6 are removed by etching. The supply paths 8 can be made open to the first surface in such a manner that portions of the etching stop layer 2 that remain on openings of the supply paths 8 in the first surface of the silicon substrate 1 are removed by dry etching. This is not shown in FIG. 2D.

An example of the present invention and a comparative example are described below.

Example

A liquid ejection head substrate was formed by the processing method according to the above embodiment. First, as shown in FIG. 2A, a polyether amide resin was deposited on a $SiO_2$ layer 4 placed on a second surface of a silicon substrate 1, whereby an etching mask layer 5 having openings was formed. Thereafter, the $SiO_2$ layer 4 was partly removed through the openings. The thickness of the silicon substrate 1 was 725 μm. The width W1 (refer to FIG. 1) of the openings was 0.75 mm.

Next, as shown in FIG. 2B, a plurality of guide holes 7 were formed in the openings of the etching mask layer 5 by laser processing. The laser processing depth was 650 μm. The interval between the guide holes 7 was 60 μm in each of a width direction and a longitudinal direction of a supply path. The guide holes 7 were formed so as to make three rows in a width direction of the silicon substrate 1.

Figure 4:
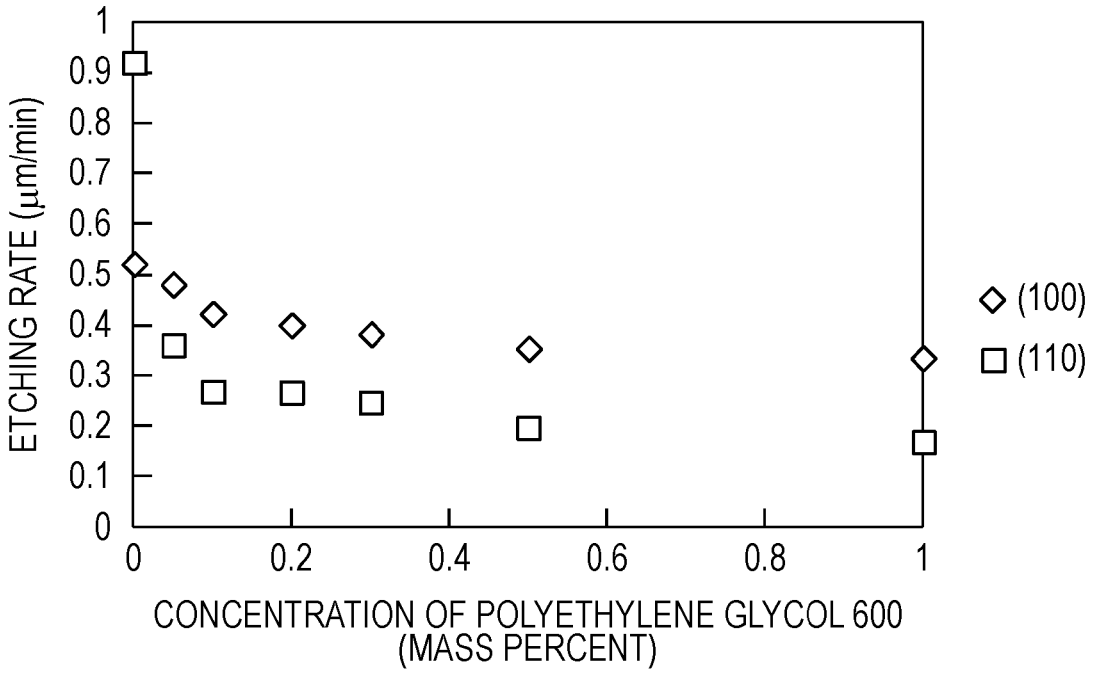
FIG. 4 is a graph showing the relationship between the concentration of polyethylene glycol and the etching rate of a silicon substrate.

Next, as shown in FIG. 2C, the second surface of the silicon substrate 1 was anisotropically etched using an etchant. The etchant used was a solution containing 22% by mass of TMAH and 0.1% by mass of polyethylene glycol 600. In the case of using the solution containing 22% by mass of TMAH and 0.1% by mass of polyethylene glycol 600, the etching rate of the (100) plane of silicon is 0.4 μm/min and the etching rate of the (100) plane of silicon is 0.17 μm/min. Thus, the etchant has a higher etching rate for a (100) plane than for a (110) plane. FIG. 4 shows the relationship between the concentration of polyethylene glycol 600 and the etching rate of a silicon substrate.

During anisotropic etching, a (111) plane is formed from the end of each guide hole 7 located outside. Since the etchant has a higher etching rate for the (100) plane than for the (110) plane, the time taken to combine the guide holes 7 together is long. Instead, etching proceeds in a depth direction such that the increase in opening width of an internal opening 9 is suppressed, after the guide holes 7 are combined together as shown in FIG. 2C.

Thereafter, anisotropic etching was performed until supply paths 8 were formed so as to extend to a first surface of the silicon substrate 1 as shown in FIG. 2D. In the obtained liquid ejection head substrate, the wall of each supply path 8 had a region substantially perpendicular to the first surface of the silicon substrate 1 and the distance from the first surface of the silicon substrate 1 to an end portion of the region that was located on the second surface side was one-half or less of the thickness of the silicon substrate 1. The position of the end portion of the region was defined as the position of the internal opening 9. The opening width W2 of the internal opening 9 in the supply path 8 was 0.35 mm and the opening width W2 of the supply path 8 in the second surface of the silicon substrate 1 was increased to 0.77 mm (refer to FIG. 1).

Comparative Example

Figure 3A:
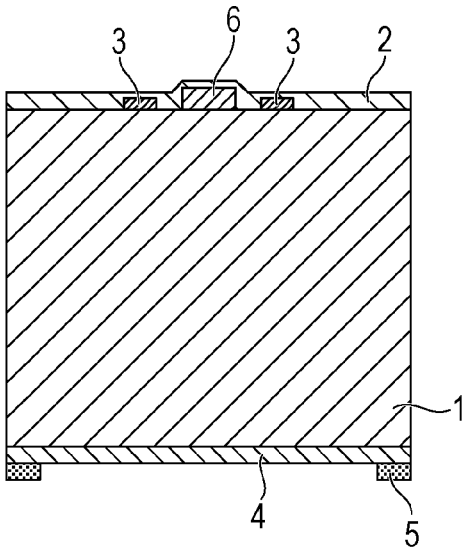
FIGS. 3A to 3D are schematic sectional views sequentially showing steps of forming a liquid ejection head substrate by a conventional processing method.
Figure 3B:
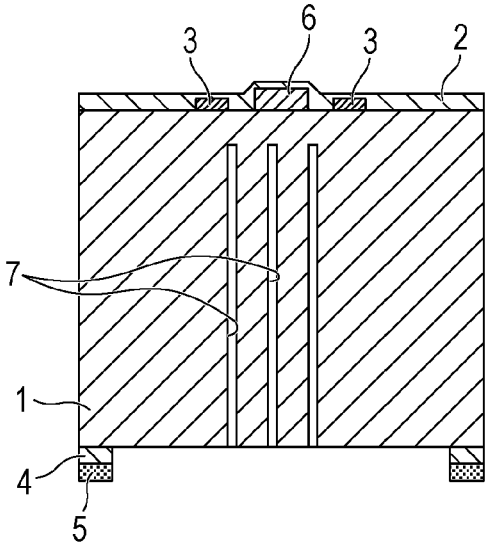
Figure 3C:
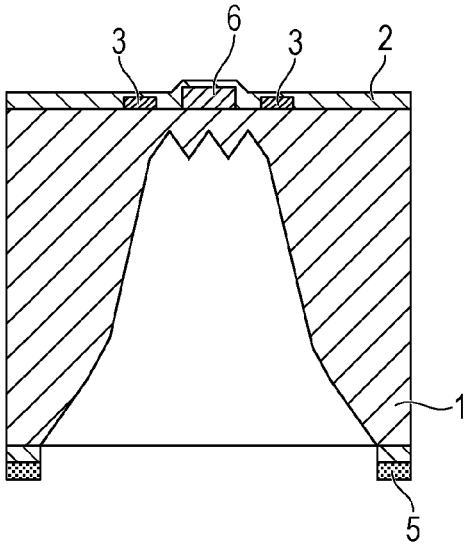
Figure 3D:
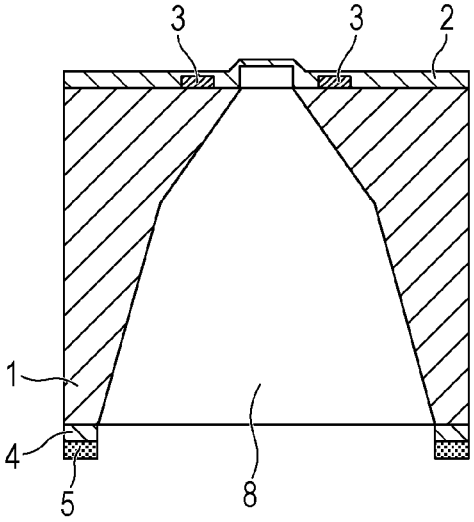

A step prior to forming guide holes 7 and a step of forming the guide holes 7 were performed as shown in FIGS. 3A and 3B by substantially the same procedure as that used to perform the steps shown in FIGS. 2A and 2B in the example. Next, a second surface of a silicon substrate 1 was anisotropically etched using an etchant. The etchant was a solution containing 22% by mass of TMAH. The etchant contained no polyethylene glycol. The etchant had an etching rate of 0.5 μm/min for a (100) plane and an etching rate of 0.975 μm/min for a (110) plane, that is, a higher etching rate for the (110) plane than for the (100) plane. Therefore, etching quickly proceeded in a width direction. As shown in FIG. 3C, etching proceeded to create a cross-sectional shape in which an intermediate portion in a thickness direction of the silicon substrate 1 laterally expanded. Thereafter, anisotropic etching was performed until supply paths 8 were formed so as to extend to a first surface of the silicon substrate 1 as shown in FIG. 3D. As a result, the opening width W2 of an internal opening 9 in each supply path 8 was 0.63 mm and the opening width W2 of the supply path 8 in the second surface of the silicon substrate 1 was increased to 0.8 mm (refer to FIG. 1). The wall of the supply path 8 finally had such a cross-sectional shape that two regions distinguished from each other due to different inclinations to the first surface of the silicon substrate 1 were connected to each other such that the width of the supply path 8 expanded toward the second surface of the silicon substrate 1. One of the two regions that was close to the second surface of the silicon substrate 1 was steeply inclined to the first surface of the silicon substrate 1. In the comparative example, such a region that the wall of the supply path 8 was substantially perpendicular to the first surface of the silicon substrate 1 was not formed and therefore the position of an internal opening could not be defined as described in the example. Therefore, in the comparative example, a position where the two regions were connected to each other was defined as the internal opening.

Conclusion

In the comparative example, the conventional etchant was used and therefore the opening width W2 of the internal opening in each supply path 8 was 0.63 mm. However, in the example, the processing method according to the above embodiment was used and therefore the internal opening was formed so as to have an opening width W2 of 0.35 mm. This suggests the processing method according to the above embodiment enables the downsizing of a liquid ejection head substrate. In the processing method according to the above embodiment, the width of the internal opening is small and therefore the amount of removed silicon is small; hence, the time taken to anisotropically etch a silicon substrate can be reduced.

In the liquid ejection head substrate formed in the example, the wall of each supply path 8 between the first surface and the second surface is divided into three or more regions having different inclinations to the first surface. One of these regions that is most steeply inclined to the first surface corresponds to the internal opening. Another one of these regions that is located between the region that is most steeply inclined and the second surface is gently inclined. Therefore, an adhesive used to mount the liquid ejection head substrate on a support member remains on the region that is gently inclined. The squeezing of the adhesive into a narrow portion of the supply path 8 is reduced and the growth of bubbles in the supply path 8 can be suppressed. Thus, in accordance with a processing method according to the present invention, small supply paths can be formed and a liquid ejection head substrate in which the interruption of liquid supply by bubbles is reduced can be provided.

In the above embodiment, a processing example in which the supply paths 8 are formed only in the silicon substrate 1 has been described. However, in the case of manufacturing a liquid ejection head, a step of forming a channel-forming member on the first surface of the silicon substrate 1 is preferably performed before a step of forming the supply paths 8 is performed. In this case, the channel-forming member is formed on the first surface of the silicon substrate 1 so as to have ejection ports ejecting liquid and a liquid channel communicating with the ejection ports.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-193672, filed Sep. 24, 2014, which is hereby incorporated by reference herein in its entirety.

What is claimed is:

1. A liquid ejection head substrate having a first surface and a second surface opposite to the first surface, comprising:

a plurality of ejection energy-generating elements placed on the first surface, a plurality of supply paths for supplying liquid to the ejection energy-generating elements, each supply path extending between the first and second surfaces, wherein a wall of the supply path has a cross-sectional shape which is perpendicular to the first surface, in which four or more regions distinguished from each other due to different inclinations to the first surface are connected to each other between the first and second surfaces, and in which a width of the supply path is maintained or expands from the first surface toward the second surface;

the regions include a first region connected to an opening of the first surface allowing the supply path to pass through, a second region connected to the first region, a third region connected to the second region, and a fourth region connected to the third region;

the second region is a portion of the wall perpendicular to the first surface;

the width of the supply path at the second region is greater than a width of the opening at the first surface;

the width of the supply path at a position where the third and fourth regions are connected to each other is greater than the width of the supply path at the second region; and a width of an opening of the second surface allowing the supply path to pass through is greater than the width of the supply path at the position where the third and fourth regions are connected to each other.

2. The liquid ejection head substrate according to claim 1, wherein the width of the internal opening on the second surface side is one-half or less of the width of the opening of each supply path in the second surface and the distance from the first surface to a position where the internal opening is formed is one-half or less of the thickness of the liquid ejection head substrate.

* * * * *